US008159451B2

(12) United States Patent
Tsuchida et al.

(10) Patent No.: US 8,159,451 B2
(45) Date of Patent: Apr. 17, 2012

(54) LIGHT-EMISSION CONTROL DEVICE AND LIQUID CRYSTAL DISPLAY APPARATUS

(75) Inventors: Masaki Tsuchida, Tokyo (JP); Ken Ito, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 669 days.

(21) Appl. No.: 12/327,741

(22) Filed: Dec. 3, 2008

(65) Prior Publication Data

US 2009/0289890 A1 Nov. 26, 2009

(30) Foreign Application Priority Data

May 26, 2008 (JP) ..... 2008-136870

(51) Int. Cl.
*G09G 3/36* (2006.01)

(52) U.S. Cl. ..... 345/102

(58) Field of Classification Search ..... None
See application file for complete search history.

(56) References Cited

U.S. PATENT DOCUMENTS

| | | | | |
|---|---|---|---|---|
| 7,113,164 | B1 | 9/2006 | Kurihara | |
| 2006/0007103 | A1 | 1/2006 | Oh et al. | |
| 2006/0214904 | A1 | 9/2006 | Kimura et al. | |
| 2006/0238487 | A1 * | 10/2006 | Shih | 345/102 |

FOREIGN PATENT DOCUMENTS

| | | |
|---|---|---|
| JP | 2002-099250 | 4/2002 |
| JP | 2004-191490 | 7/2004 |
| JP | 2004317895 | 11/2004 |
| JP | 2005-338857 | 12/2005 |
| JP | 2007-034251 | 2/2007 |
| JP | 2007183499 | 7/2007 |
| JP | 2007-219234 | 8/2007 |
| JP | 2008-020611 | 1/2008 |
| JP | 2008-090076 | 4/2008 |

OTHER PUBLICATIONS

Japanese Patent Application No. 2008-136870, Notice of Rejection, mailed Apr. 7, 2009 (Partial English translation).
Japanese Patent Application No. 2009-137729, Notice of Reasons for Rejection, mailed Apr. 12, 2011, (English Translation).

* cited by examiner

*Primary Examiner* — Joseph Haley
(74) *Attorney, Agent, or Firm* — Blakely, Sokoloff, Taylor & Zafman LLP

(57) ABSTRACT

According to one embodiment, a light-emission control device controls light emission of light sources of a light emitter including a plurality of light source areas each corresponding to one of the light sources, and includes a virtual light-value calculator, a light-value calculator, and a light controller. The virtual light-value calculator calculates a virtual light value for each virtual light source area including a light source area and a virtual area obtained by virtually dividing the light emitter into areas different in size from the light source areas. The light-value calculator calculates a light value of a light sources corresponding to the light source area based on the virtual light value. The light controller lights the light source based on the light value.

14 Claims, 7 Drawing Sheets

LIGHT-EMISSION CONTROL DEVICE AND LIQUID CRYSTAL DISPLAY APPARATUS

CROSS-REFERENCE TO RELATED APPLICATIONS

This application is based upon and claims the benefit of priority from Japanese Patent Application No. 2008-136870, filed May 26, 2008, the entire contents of which are incorporated herein by reference.

BACKGROUND

1. Field

One embodiment of the invention relates to a light-emission control device that controls light emission of a light emitter, and a liquid-crystal display apparatus with the light-emission control device.

2. Description of the Related Art

Currently available televisions, personal computers, mobile phones, etc. are generally equipped with a liquid-crystal display apparatus that displays images. Such a liquid-crystal display apparatus includes a liquid crystal panel, which by itself does not emit light but is illuminated by a light emitter, such as a backlight, located behind it.

Some conventional liquid-crystal display apparatuses with backlight are configured with a view to reducing power consumption. In such a configuration, the display screen is associated with light sources that constitute the backlight and divided into a plurality of areas (screen areas), and the light sources are controlled area by area.

Among this type of liquid-crystal display apparatuses is the one disclosed in Japanese Patent Application Publication (KOKAI) No. 2004-191490. This liquid-crystal display apparatus calculates the maximum luminance of each screen area based on input video signal, and causes the light source in each screen area to emit light based on the maximum luminance, and corrects luminance information supplied to a liquid crystal panel.

In a liquid-crystal display apparatus that controls the light sources area by area, a light value at which each light source is lit and the transmittance of each liquid crystal element forming the liquid crystal panel are correlated to control the luminance of the liquid crystal panel to a desired value.

However, even if the light value at which each light source is lit and the transmittance of each liquid crystal element of the liquid-crystal panel are correlated, a video image with sharp brightness variation (e.g., a video image which is predominantly dark with a small area of light) cannot be displayed with appropriate luminance.

BRIEF DESCRIPTION OF THE SEVERAL VIEWS OF THE DRAWINGS

A general architecture that implements the various features of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, a light-emission control device controls light emission of a plurality of light sources of a light emitter that illuminates a liquid crystal panel and that includes a plurality of light source areas in each of which is arranged one of the light sources. The light-emission control device includes: a virtual light-value calculator configured to calculate a virtual light value for each virtual light source area that includes one of the light source areas and a virtual area obtained by virtually dividing the light emitter into areas different in size from the light source areas; a light-value calculator configured to calculate a light value of one of the light sources corresponding to the one of the light source areas based on the virtual light value calculated by the virtual light-value calculator; and a light controller configured to light the one of the light sources based on the light value calculated by the light-value calculator.

According to another embodiment, a liquid-crystal display apparatus includes a liquid crystal panel, a light emitter that includes a plurality of light source areas in each of which is arranged one of a plurality of light sources for illuminating the liquid crystal panel, and a light-emission control device that controls light emission of the light sources. The liquid-crystal display apparatus further includes: a virtual light-value calculator configured to calculate a virtual light value for each virtual light source area that includes one of the light source areas and a virtual area obtained by virtually dividing the light emitter into areas different in size from the light source areas; a light-value calculator configured to calculate a light value of one of the light sources corresponding to the one of the light source areas based on the virtual light value calculated by the virtual light-value calculator; and a light controller configured to light the one of the light sources based on the light value calculated by the light-value calculator.

Figure 1:
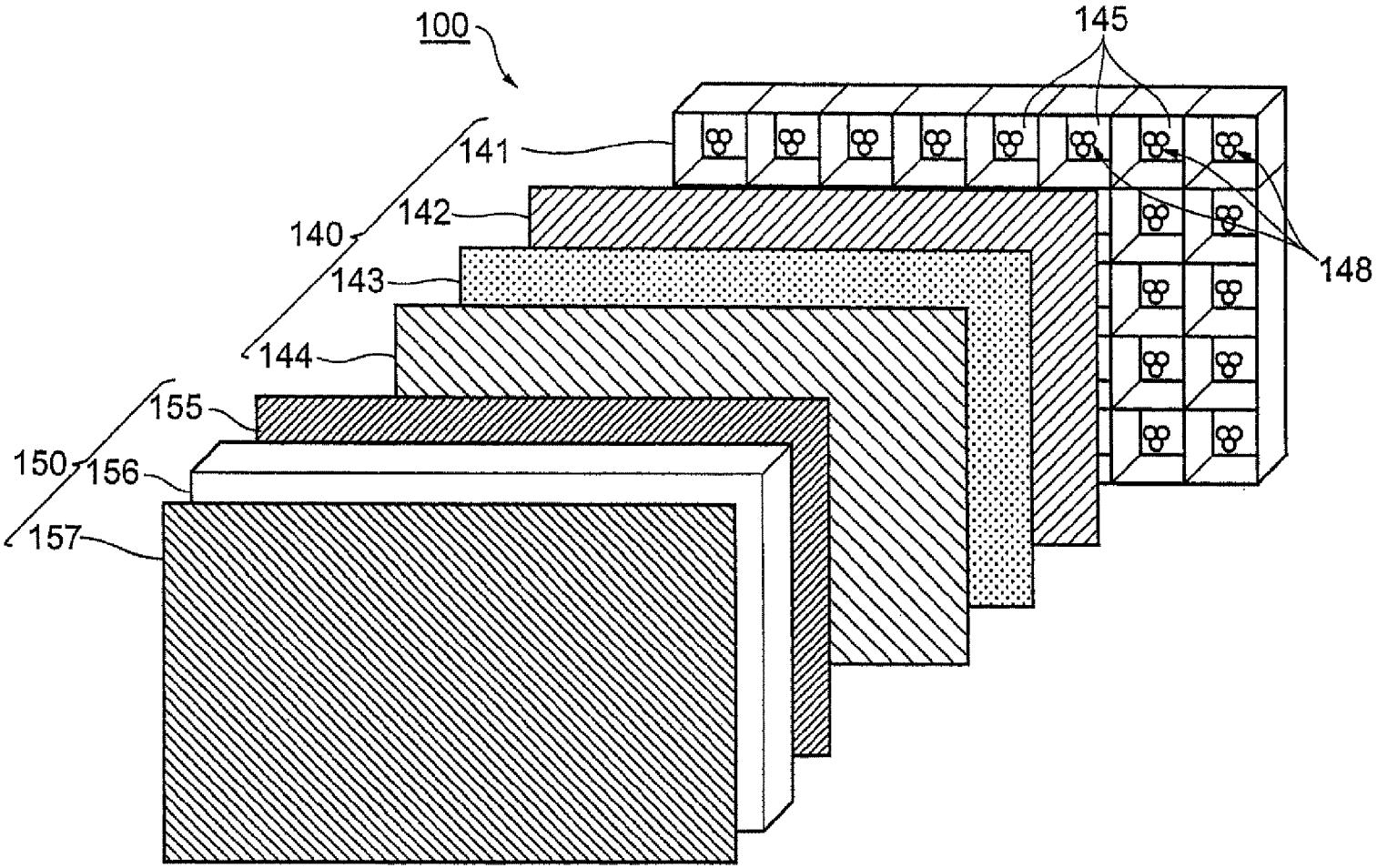
FIG. 1 is an exemplary exploded perspective view of a liquid-crystal display apparatus according to an embodiment of the invention.
Figure 2:
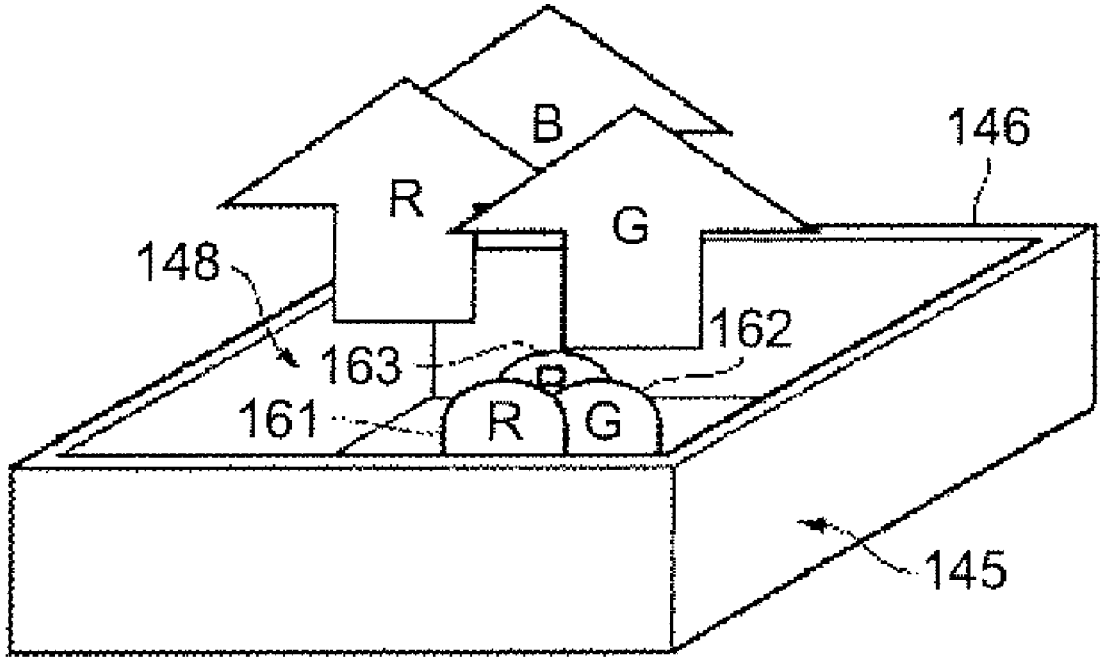
FIG. 2 is an exemplary perspective view of a light source area and a light source in the embodiment.

A configuration of a liquid-crystal display apparatus 100 according to an embodiment of the invention is explained below with reference to FIGS. 1 and 2. FIG. 1 is an exploded perspective view of the liquid-crystal display apparatus 100. FIG. 2 is a perspective view of a light source area and a light source.

The liquid-crystal display apparatus 100, used in a liquid crystal television, etc., includes a backlight 140 and a liquid crystal panel 150 as illustrated in FIG. 1.

The backlight 140 that functions as a light emitter and includes a light emitter (light emitter) 141, a prism sheet 143 disposed in front of the light emitter 141, and a pair of diffusion plates 142 and 144 with the prism sheet 143 in between them.

The light emitter 141 is in the form of a panel having a plurality of light source areas 145 arranged regularly in a matrix of M rows and N columns. In FIG. 1, the light source areas 145 of the light emitter 141 are arranged in a matrix of, for example, five rows and eight columns.

As can be seen from FIG. 2, each of the light source areas 145 is enclosed on four sides by partition walls 146 that extend in the direction of the diffusion plate 142.

Each of the light source area 145 includes a light source 148 formed of light emitting devices (LEDs) 161 to 163 corresponding to the three primary colors of red, green, and blue (RGB), respectively. The light source 148 emits a mixed light of red, green, and blue from the red LED 161, the green LED 162, and the blue LED 163r respectively, toward the front (i.e., toward the liquid crystal panel 150). The back surface of the liquid crystal panel 150 is illuminated by the light emitted from the light source areas 145, and the transmittance thereof is adjusted to display an image.

The liquid-crystal display apparatus 100 is of direct backlight type in which the entire surface of the backlight 140 emits light from the light sources 148 of the light source areas 145, thereby illuminating the liquid crystal panel 150 from the back.

The liquid crystal panel 150 includes a pair of polarizing plates 155 and 157, and a liquid crystal cell 156 disposed between the polarizing plates 155 and 157.

Figure 3:
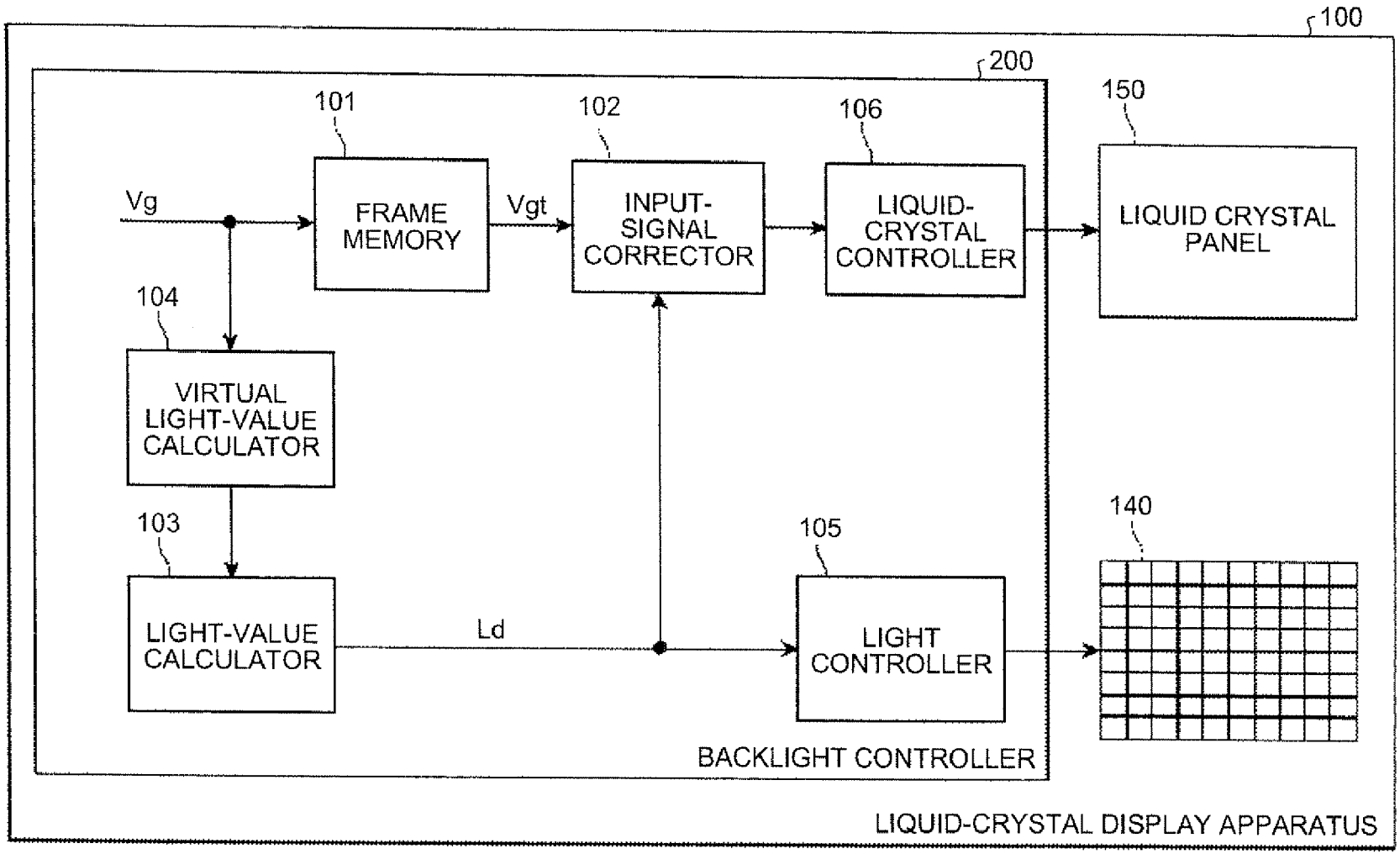
FIG. 3 is an exemplary block diagram of a backlight controller together with a backlight and a liquid crystal panel in the embodiment.

A backlight controller 200 is explained below with reference to FIG. 3. FIG. 3 is a block diagram of the backlight controller 200 together with the backlight 140 and the liquid crystal panel 150.

In addition to the backlight 140 and the liquid crystal panel 150, the backlight controller 200 is provided to the liquid-crystal display apparatus 100. The backlight controller 200 functions as a light-emission control device that controls the light emitted by the light sources 148 of the backlight 140.

The backlight controller 200 includes a frame memory 101, an input-signal corrector 102, a light-value calculator 103, a virtual light-value calculator 104, a light controller 105, and a liquid crystal controller 106.

The backlight controller 200 receives a video signal Vg required for displaying a video image on the liquid crystal panel 150.

In the backlight controller 200, the video signal Vg is supplied to the frame memory 101 and the virtual light-value calculator 104. The frame memory 101 stores therein the video signal Vg for every frame. The input-signal corrector 102 corrects a video signal Vgt read from the frame memory 101 based on a calculated light value Ld calculated by the light-value calculator 103, described later, and outputs it to the liquid crystal controller 106. When correcting the video signal Vgt read from the frame memory 101, the input-signal corrector 102 establishes a correlation between the video signal Vgt and the calculated light value Ld. The liquid crystal controller 106 controls the transmittance of the liquid crystal panel 150 based on the corrected video signal Vgt. The backlight controller 200 appropriately matches the timing of displaying an image by the liquid crystal panel 150 with the timing of turning on the light sources 148.

The virtual light-value calculator 104 calculates, based on the video signal Vg, a light value (virtual calculated value) LD0 of the light source 148 for every virtual light source area 120, described later, and outputs the light value LD0 to the light controller 105. The light controller 105 lights the light source 148 in each of the light source areas 145 based on the calculated light value Ld to emit light from the backlight 140.

The operation of the backlight controller 200 configured as above is described below with reference to FIGS. 4A, 4B, 5, and 6 with particular reference to the operation of the virtual light-value calculator 104.

Figure 4A:
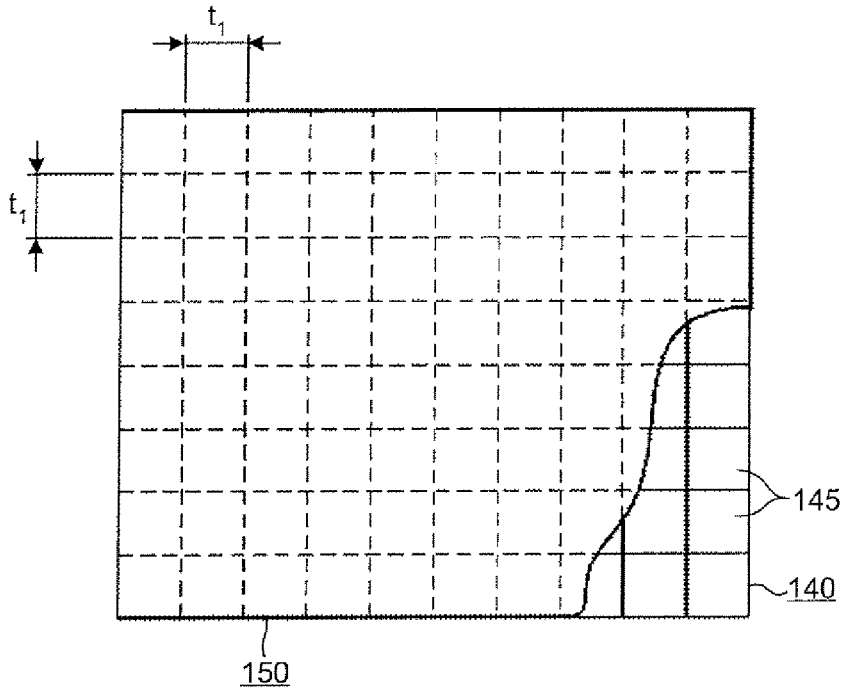
FIG. 4A is an exemplary schematic diagram of the backlight divided into a grid in a division unit of t1 in the embodiment.
Figure 5:
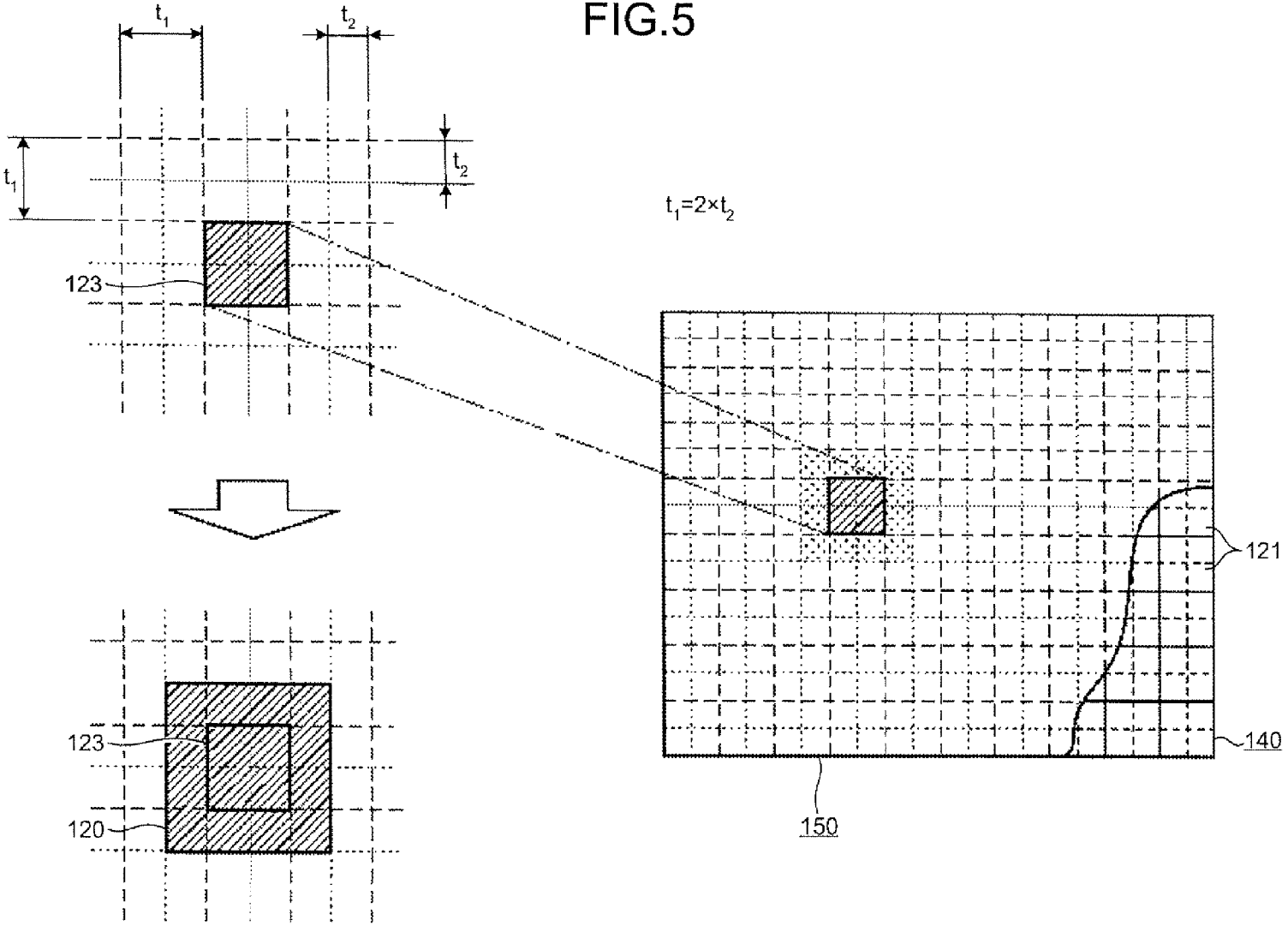
FIG. 5 is an exemplary schematic diagram of a virtual light source area in the embodiment.
Figure 6:
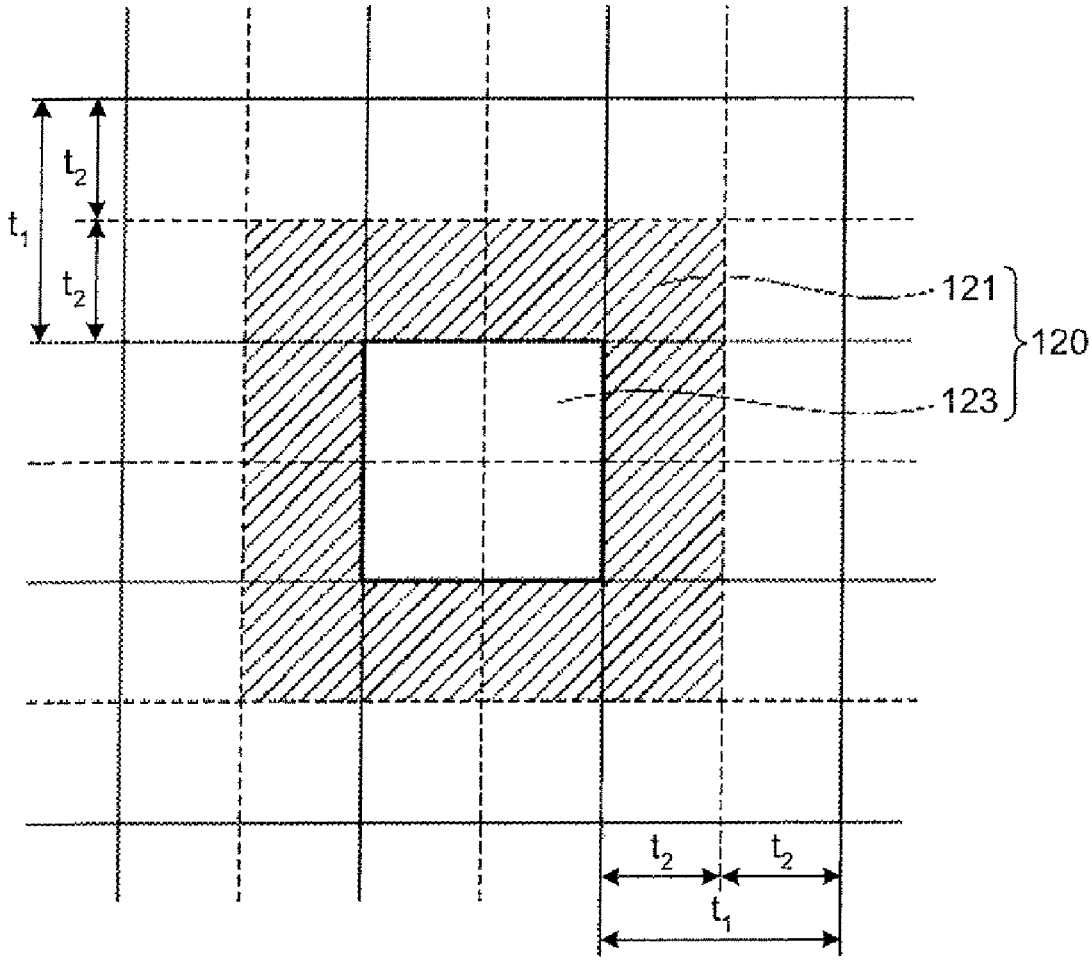
FIG. 6 is an exemplary enlarged view of the virtual light source area of FIG. 5 in the embodiment.

The backlight 140 is divided into a regular grid of light source areas 145 and further subdivided into virtual areas 121 of smaller size. In the present embodiment, the virtual light source area is defined as including the virtual area 121 and the light source area 145. As illustrated in FIGS. 4A, 5, and 6, each area obtained by dividing the backlight 140 into a regular grid of cells each having a side of length t1 is defined as the light source area 145. That is, in the present embodiment, the length t1 is defined as the division unit in which the backlight 140 is divided into the light source areas 145. The light-value calculator 103 calculates the light value of the light source 148 for each of the light source areas 145.

Figure 4B:
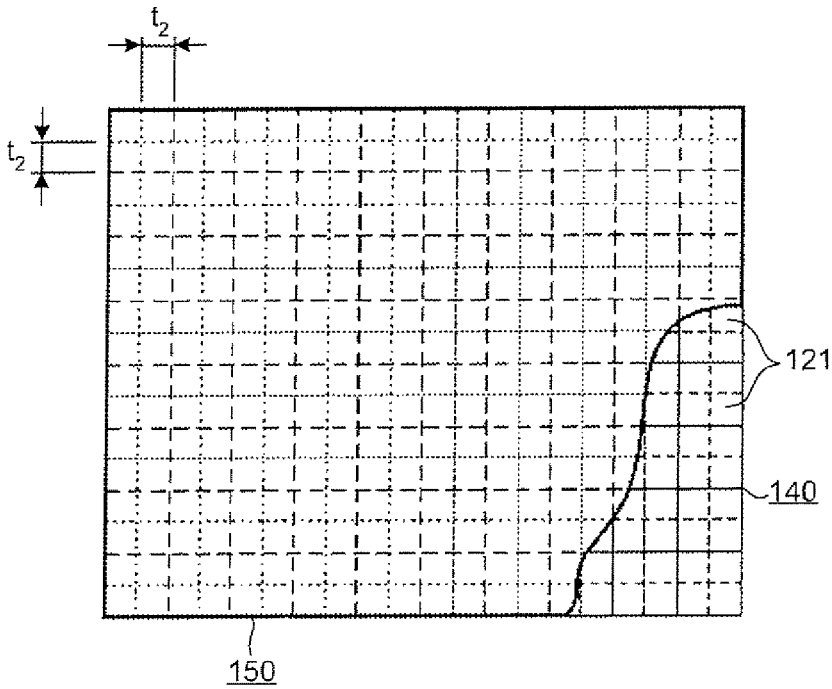
FIG. 4B is an exemplary schematic diagram of the backlight divided into a grid in a virtual division unit of t2 in the embodiment.

As illustrated in FIGS. 4B, 5, and 6, the virtual light-value calculator 104 virtually divides the backlight 140 into a regular grid of the virtual areas 121 in a division unit t2 (virtual division unit) smaller than the division unit t1, and calculates the light value of the light source 148 for every virtual light source area 120 including the virtual areas 121. Thus, the backlight 140 is virtually divided in the virtual division unit t2 into a regular grid of areas smaller than the light source areas 145.

The light source area 145 actually physically exists, whereas the virtual area 121 does not but is virtually defined. The backlight 140 can be divided in the division unit t2 on the basis of, for example, the coordinates of the liquid crystal elements, each representing a pixel, of the liquid crystal panel 150.

If the backlight 140 is virtually divided in the virtual division unit t2 into the virtual areas 121, then, as illustrated in FIGS. 5 and 6, some of the virtual areas 121 surround a light source area (target area 123) for which a light value is to be calculated, and the target area 123 and the virtual areas 121 around it form the virtual light source area 120.

Generally, as illustrated in FIG. 5, the light value necessary for the light source 148 of the target area 123 to emit light of required luminance is calculated based on the value of a video signal corresponding to the target area 123. Although no particular method is specified for this calculation, any of the following methods can be adopted. The video signal Vg having the maximum luminance value is found in the region corresponding to the target area 123, and the light value can be calculated based on the maximum luminance value. Alternatively, the average luminance value of the video signals Vg is obtained in the region corresponding to the target area 123, and the light value can be calculated based on the average luminance value.

The virtual light-value calculator 104 calculates a light value for the virtual light source area 120 including the virtual areas 121 virtually formed by subdividing the backlight 140 in the division unit t2 smaller than the division unit t1 of the light source areas 145. That is, the light value can be calculated considering the virtual areas 121 surrounding the target area 123.

Thus, the virtual light-value calculator 104 reflects luminance Information of the video signals Vg in the virtual areas 121 in the calculation of the light value, thereby calculating the light value allowing the light sources 148 to light brighter. This is explained below by presenting an example.

Consider a video image that is predominantly dark and includes a small rectangular portion at a gray level of 255 (hereinafter, "small rectangular portion") occupying a few percent of the screen area, such as that of a small fishing boat with a small white light on the sea in darkness. Such a video image shows a sharp brightness variation at the border of the small rectangular portion.

If light values are calculated for the light source areas 145 of a video image as above by the conventional method, and if the edge of the rectangular portion lies at the edge of the light source area 145, because a portion adjacent to the edge in the video image is dark, it is determined that there is no video signal in the light source area 145 corresponding to the adjacent portion, and the light value is calculated on the assumption that there is no need for light from the light source 148 in that portion. As a result, the light source 148 is not lit in that portion.

Due to limitations in the light intensity of the light source 148, when a video image is displayed in which a specific portion (the small rectangular portion in the above example) is particularly bright, it may not be possible to brighten the specific portion to the desired level by the light from the light source area 145 corresponding thereto. Therefore, the shortage of light intensity needs to be compensated for by the light from the light sources 148 of the surrounding light source areas 145. If alight value is calculated for the specific light source area 145, the surrounding light sources 148 are not lit, and hence the shortage of light intensity is not compensated for. Consequently, in a video image including the small rectangular portion, the edge portion of the small rectangular portion appears dark because of insufficient luminance at the edge portion.

Therefore, in the present embodiment, the virtual light-value calculator 104 is provided for calculating the light value for the virtual light source area 120 that includes the virtual areas 121, thus taking an area that is larger than the actual area into consideration for calculating the light value. With this, insufficient luminance of an edge portion, etc. can be compensated for, and the video image can be displayed with its original luminance.

Figure 7:
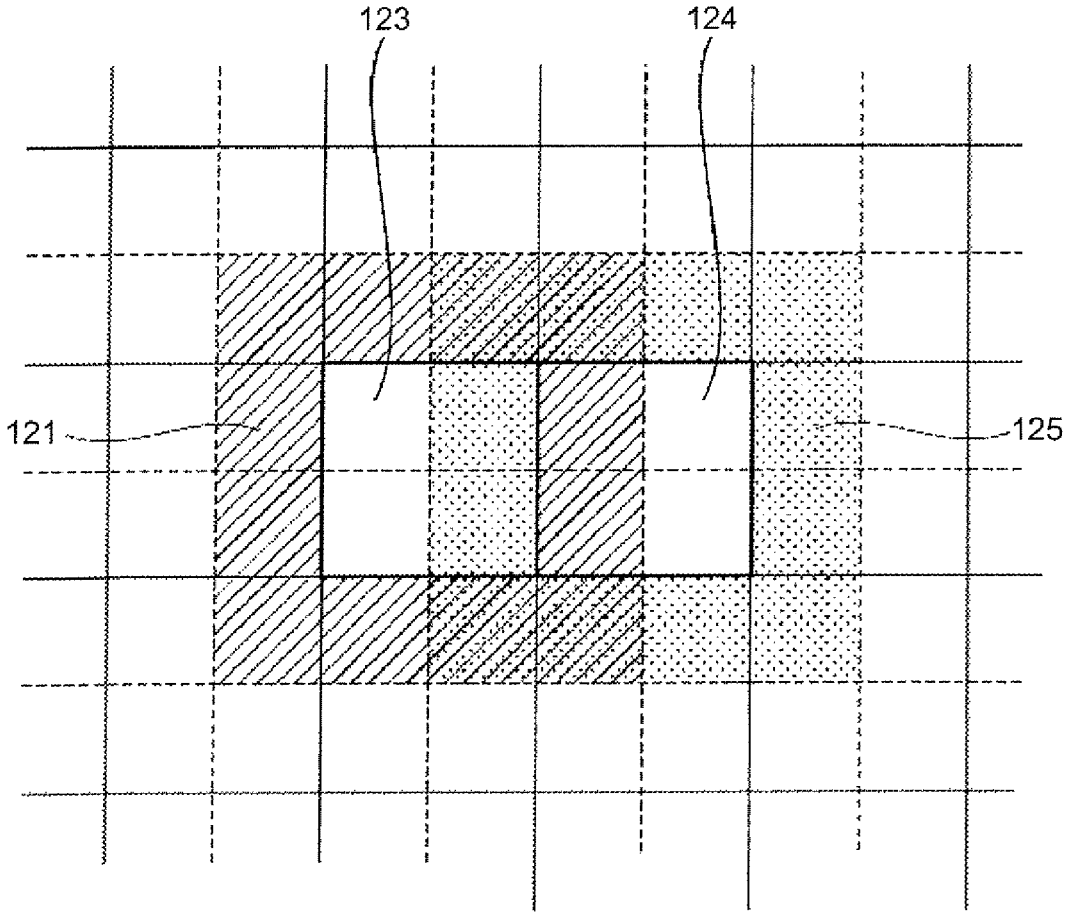
FIG. 7 is an exemplary schematic diagram of adjacent virtual light source areas in the embodiment.

For example, as illustrated in FIG. 7, two adjacent target areas 123 and 124 are considered, of which the target area 123 is the small rectangular area. The hatched portion represents the virtual areas 121 around the target area 123 and the dotted portion represents virtual areas 125 around the target area 124. If the brightness of the target area 123 is particularly high, sufficient light intensity may not be achieved by the light from only the light source 148 of the light source area 145 corresponding to the target area 123.

By providing the virtual areas 125 around the target area 124 adjacent to the target area 123, the virtual light-value calculator 104 is able to reflect the brightness of the target area 123 in the calculation of the light value. In other words, the virtual light-value calculator 104 reflects luminance information of the virtual areas 125 in the calculation of the light value for the target area 124, and thereby the portion of the virtual area 125 overlapping the target area 123 can be brighten up. Thus, the shortage of light intensity can be compensated for by the light from the light sources 148 corresponding to the target area 124.

In the present embodiment, the division unit t1 of the light source area 145 is described as, for example, twice the division unit t2. The division unit t1 can be more than twice (for example, three times) the division unit t2.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A light-emission control device that controls light emission of a plurality of light sources of a light emitter that illuminates a liquid crystal panel, the light emitter including a plurality of light source areas in each of which is arranged one of the light sources, the light-emission control device comprising:

a virtual light-value calculator configured to calculate a virtual light value for each virtual light source area that includes one of the light source areas and a virtual area obtained by virtually dividing the light emitter into areas different in size from the light source areas;

a light-value calculator configured to calculate a light value of one of the light sources corresponding to the one of the light source areas based on the virtual light value calculated by the virtual light-value calculator; and a light controller configured to light the one of the light sources based on the light value calculated by the light-value calculator, wherein the light-value calculator calculates the light value based on any one of a maximum luminance value and an average luminance value in the virtual light source area while reflecting luminance information of the virtual area in calculation of the light value.

2. The light-emission control device according to claim 1, wherein the virtual area is obtained by virtually dividing the light emitter into areas smaller in size than the light source areas.

3. The light-emission control device according to claim 2, wherein the light source areas are obtained by dividing the light emitter in a unit twice or more than twice as large as a unit for virtually dividing the light emitter to obtain the virtual area.

4. The light-emission control device according to claim 3, wherein the light-value calculator reflects luminance information of the virtual area in calculation of the light value.

5. The light-emission control device according to claim 1, further comprising:

a storage module configured to store therein an input video signal for each frame;

a corrector configured to correct the video signal stored in the storage module based on the light value calculated by the light-value calculator and outputs a corrected video signal; and liquid-crystal controller configured to control the liquid crystal panel based on the corrected video signal.

6. A liquid-crystal display apparatus including a liquid crystal panel, a light emitter that includes a plurality of light source areas in each of which is arranged one of a plurality of light sources for illuminating the liquid crystal panel, and a light-emission control device that controls light emission of the light sources, the liquid-crystal display apparatus comprising:

a virtual light-value calculator configured to calculate a virtual light value for each virtual light source area that includes one of the light source areas and a virtual area obtained by virtually dividing the light emitter into areas different in size from the light source areas;

a light-value calculator configured to calculate a light value of one of the light sources corresponding to the one of the light source areas based on the virtual light value calculated by the virtual light-value calculator; and a light controller configured to light the one of the light sources based on the light value calculated by the light-value calculator, wherein the light-value calculator calculates the light value based on any one of a maximum luminance value and an average luminance value in the virtual light source area while reflecting luminance information of the virtual area in calculation of the light value.

7. The liquid-crystal display apparatus according to claim 6, wherein the virtual area is obtained by virtually dividing the light emitter into areas smaller in size than the light source areas.

8. The liquid-crystal display apparatus according to claim 6, wherein the light source areas are obtained by dividing the light emitter in a unit twice or more than twice as large as a unit for virtually dividing the light emitter to obtain the virtual area.

9. A video processor comprising:

a liquid crystal panel;

a light emitter configured to illuminate the liquid crystal panel, the light emitter including a plurality of light source areas in each of which is arranged a light source;

a virtual value calculator configured to calculate a virtual value used to calculate a light value for each of the light source areas based on a luminance in an area of the liquid crystal panel corresponding to a virtual light source area including one of the light source areas and a plurality of virtual areas around the light source area to control light emission of the light source arranged in the light source area, the virtual areas being obtained by virtually dividing the light source areas;

a light-value calculator configured to calculate the light value for each of the light source areas to control brightness of the light source based on the virtual value calculated by the virtual value calculator; and a light controller configured to light the light source based on the light value calculated by the light-value calculator, wherein the light-value calculator calculates the light value based on any one of a maximum luminance value and an average luminance value in the virtual light source area while reflecting luminance information of the virtual area in calculation of the light value.

10. The video processor of claim 9, wherein each of the light source areas is rectangular in shape, and the virtual light source area used to calculate the virtual value includes all virtual areas horizontally, vertically, and diagonally adjacent to the light source area.

11. The video processor of claim 9, wherein the virtual areas are obtained by virtually dividing the light emitter into areas smaller in size than the light source areas.

12. The video processor of claim 11, wherein the virtual areas are obtained by virtually dividing the light emitter into areas each equal to or smaller than half of each of the light source areas.

13. The video processor of claim 9, further comprising:

a storage module configured to store an input video signal frame by frame;

a corrector configured to correct the video signal stored in the storage module based on the light value calculated by the light-value calculator and outputs a corrected video signal; and a liquid-crystal controller configured to control the liquid crystal panel based on the video signal corrected by the corrector.

14. A video processor configured to control a light emitter that illuminates a liquid crystal panel including a plurality of light source areas in each of which is arranged a light source, the video processor comprising:

a virtual value calculator configured to calculate a virtual value used to calculate a light value for each of the light source areas based on a luminance in an area of the liquid crystal panel corresponding to a virtual light source area including one of the light source areas and a plurality of virtual areas around the light source area to control light emission of the light source arranged in the light source area, the virtual areas being obtained by virtually dividing the light source areas;

a light-value calculator configured to calculate the light value for each of the light source areas to control brightness of the light source based on the virtual value calculated by the virtual value calculator; and a light controller configured to light the light source based on the light value calculated by the light-value calculator, wherein the light-value calculator calculates the light value based on any one of a maximum luminance value and an average luminance value in the virtual light source area while reflecting luminance information of the virtual area in calculation of the light value.

* * * * *